United States Patent [19]

McBee et al.

[11] 4,239,547

[45] Dec. 16, 1980

[54] RECYCLING SPENT ASPHALTIC CONCRETE

[75] Inventors: William C. McBee; Thomas A. Sullivan, both of Boulder City, Nev.

[73] Assignee: The United States of America as represented by the Secretary of the Interior, Washington, D.C.

[21] Appl. No.: 2,829

[22] Filed: Jan. 12, 1979

[51] Int. Cl.[3] ..... C08L 95/00

[52] U.S. Cl. ..... 106/274; 106/281 R

[58] Field of Search ..... 106/274, 277; 208/39

[56] References Cited

U.S. PATENT DOCUMENTS 3,738,853 6/1973 Kopvillem et al. ..... 106/274

FOREIGN PATENT DOCUMENTS 393454 6/1933 United Kingdom .

1076866 7/1967 United Kingdom .

*Primary Examiner*—Theodore Morris

*Attorney, Agent, or Firm*—William S. Brown; Donald A. Gardiner

[57] ABSTRACT

Spent asphaltic concrete is recycled by crushing, heating and admixing with sulfur at elevated temperature.

4 Claims, No Drawings

RECYCLING SPENT ASPHALTIC CONCRETE

Conventional asphaltic concrete paving materials comprise a major proportion of aggregate and an amount of asphalt cement sufficient to serve as a binder for the aggregate. The asphalt cement may consist of asphalt alone, or may include fillers or structuring materials such as sulfur, mineral dusts and fly ash, depending on the type of aggregate material employed. Such paving materials eventually become embrittled due to increased viscosity of the asphalt binder through weathering and oxidation, resulting in failure of the materials. Recycle of the spent asphaltic materials to prepare new asphaltic paving is highly desirable in order to conserve both asphalt and aggregate material, as well as solving a waste disposal problem.

Various prior art processes have been employed for recycling of spent asphaltic paving materials. All of these processes, however, rely on the use of petroleum hydrocarbon additives to rejuvenate the asphalt binder in the recycled material. Such additives have the disadvantage of being expensive, and of being volatile at ordinary pavement temperatures whereby they are gradually lost from the pavement.

It has now been found, according to the process of the invention, that spent asphaltic concrete paving material may be effectively and economically recycled by means of a process comprising heating the spent material to a suitable mixing temperature, i.e., about 120° to 150° C., in a nonoxidizing atmosphere, and mixing the heated material at that temperature with sulfur for a time sufficient to provide thorough mixing and reaction between the sulfur and the asphalt binder. This results in lowering the viscosity and increasing the penetration point of the binder with minimal lowering of the softening point. In addition, the sulfur is not lost from the recycled material, as are the volatile petroleum hydrocarbons employed in the prior art, with a resulting longer life expectancy for the recycled material. The process of the invention has been found to be particularly effective in recycling spent asphaltic paving material in which the aggregate consists of well graded aggregate materials such as graded crushed limestone or basalt, or combinations of the two, in which the particle sizes of the aggregate vary from about ¾ inch to 200 mesh.

The spent paving material is initially crushed to a suitable size, generally to about minus 2-inch diameter chunks, and is then heated to a temperature of about 120° to 150° C. in a substantially nonoxidizing atmosphere. The heating may be accomplished by any conventional means such as a microwave heating unit, a heat exchanger unit, a drum mixer, or a heating unit in which hot aggregate material is blended with unheated recycle material to give the proper temperature. Microwave heating has been found to be particularly advantageous since the spent paving material may be readily heated to the required temperature without burning or oxidation of the asphaltic binder, and with minimum energy requirements.

Mixing of the heated spent paving material and the sulfur is accomplished by conventional mixing or blending means, such as the use of a pug mill or drum mixer of the type used in mixing hot-mix asphaltic concrete. The sulfur is usually most conveniently added in liquid form at a temperature within the range required for the mixing steps, i.e., 120° to 150° C. It may, however, be added in solid form provided sufficient heat and mixing are provided to ensure melting of the sulfur, as well as reaction with the asphalt binder. Generally, where efficient mixing means such as a pug mill are employed, a mixing time of about 15 seconds to 3 minutes is sufficient when liquid sulfur is employed. Use of less efficient mixing means, or of solid sulfur, may require longer mixing times for optimum results.

Optimum amounts of sulfur added in the mixing step will depend on the specific conditions and composition of the spent recycle material, but an amount in the range of about 20 to 50 percent by weight of the asphalt binder in the recycle material is generally satisfactory. This will generally amount to about 0.75 to 2 weight percent sulfur based on the total recycle material, i.e., the combination of aggregate and binder.

Although addition of sulfur alone will usually be sufficient to accomplish the objectives of the invention, it may also be desirable to add additional asphalt, along with the sulfur in the mixing step. This is particularly true where considerable uncoated aggregate material is present in the crushed recycle material. In such cases, addition of about 0.25 to 1 weight percent of asphalt, based on the total recycle material, is sufficient to recoat any exposed aggregate.

In the mixing step the liquid sulfur and asphalt react and combine to form a sulfur-asphalt binder that bonds the aggregate material together. The hardening of the old asphalt binder, due to weathering and oxidation, is thereby reduced to give a softened binder with properties similar to those of new asphaltic binders. The resultant products, on laying and compacting, have properties that are at least equivalent to the original asphaltic concrete paving materials.

The process of the invention will be more specifically illustrated by the following example.

EXAMPLE

Spent asphaltic paving material salvaged from a runway at Nellis Air Force Base, Las Vegas, Nevada, was recycled in accordance with the process of the invention, as well as the prior art. The spent material consisted of 4.50 weight percent asphalt, with the remainder consisting essentially of a limestone aggregate having approximately the following particle size distribution: 6.3% minus 200 mesh, 11.2% minus 100 mesh, 16.3% minus 50 mesh, 20.6% minus 30 mesh, 25% minus 16 mesh, 41.2% minus 8 mesh, 57% minus 4 mesh, 78% minus ½ inch and 100% minus 1 inch.

The spent material was crushed to minus 1-inch particle size with a conventional jaw crusher and was recycled using no additives, sulfur, sulfur plus asphalt, and Paxole 1009, the latter being a light aromatic hydrocarbon oil that is conventionally used as a softening agent for asphalt and other materials. 5000 grams of the crushed spent material was heated to 150° C. in a microwave oven in approximately 25 minutes. The heated material was placed in a 20 quart Hobart mixer and, while mixing, one of the heated (to 150° C.) additives was added and mixed with the spent material for 2 minutes at 150° C. In the case where no additive was used the heated material (at 150° C.) was also mixed for 2 minutes.

After mixing, the material was compacted at 125° to 140° C. using 75 blows of a 10-pound compaction hammer to each side to simulate heavy traffic conditions. This procedure is in accordance with standard Marshall ASTM tests for evaluation of paving material. Marshall stability and flow, voids content and resilient modulus determinations were made on the resulting sample. Results are given in Table 1, below. As will be seen in Table 1, the Marshall stability, which is a measure of the bearing or loading strength of the paving material, is actually increased somewhat by the addition of sulfur. Although the stability was decreased by addition of the combination of sulfur and asphalt, the value was still well above the accepted minimum value of 750 lb. Values of Marshall flow, which is a measure of the flexibility of the material, were substantially increased by addition of either sulfur or the combination of sulfur and asphalt. The flow value for the material without additives, i.e., a value of 7, is below the value that is considered acceptable for paving material, i.e., a value of 8.

As also seen in the Table 1, the percent of voids in the recycled material was decreased with addition of either sulfur or a combination of sulfur and asphalt, an indication of improved workability of the material. Resilient modulus, commonly referred to as dynamic stiffness, was also decreased, indicating decreased brittleness with addition of either sulfur or the combination of sulfur and asphalt.

As noted in Table 1, recycling with addition of Paxole 1009 also resulted in generally improved properties. However, as discussed above, such materials have the disadvantage of being very expensive, as compared to sulfur, as well as being volatile and therefore deficient for long term use.

In addition to the above tests on the recycled paving material, additional tests were made on the asphalt component of the recycled material. The asphalt component was obtained by extracting the recycled material with benzene. Results are given in Table 2. It will be seen that both sulfur and sulfur plus asphalt, as well as Paxole 1009 plus asphalt, were very effective in lowering the viscosity of the asphalt, without a significant lowering of the softening point. In fact, the lowering of the softening point was significantly less with the sulfur and sulfur plus asphalt than with the Paxole 1009 plus asphalt.

TABLE 1

| Additives, wt-pct | Marshall Stability, lb. | Marshall Flow, 0.01 in | Voids, pct | Resilient modulus, $\times 10^6$ psi |
|---|---|---|---|---|
| None | 9,260 | 7 | 6.7 | 4.85 |
| 1.25 Sulfur | 9,330 | 13 | 4.4 | 3.27 |
| 1.25 Sulfur, 1.0 asphalt | 4,125 | 18 | 2.6 | 3.59 |
| 0.50 Paxole, 1.25 asphalt | 4,640 | 14 | 2.3 | 2.27 |

TABLE 2

| Additives, wt-pct | Viscosity at 135° C., cp | Penetration, 0.01mm | Softening point °F. |
|---|---|---|---|
| None | 7,800 | 8 | 180 |
| 1.25 Sulfur | 1,100 | 25 | 144 |
| 1.25 Sulfur, 1.0 asphalt | 1,135 | 26 | 146 |
| 0.50 Paxole, 1.25 asphalt | 880 | 44 | 123 |

Similar tests were also carried out using different spent asphaltic paving material. These included materials salvaged from Boulder Highway, U.S. 93, Henderson, Nev., and from U.S. Interstate 15, Las Vegas, Nev. with aggregate materials consisting essentially of basalt, and a combination of limestone and basalt, respectively. Results obtained were similar to those of the above example, particularly with respect to lowering of the viscosity of the asphalt binder without a significant lowering of the softening point.

We claim:

1. A process for recycling spent embrittled asphaltic concrete, said spent concrete consisting essentially of asphalt of increased viscosity and graded mineral aggregate, comprising (1) crushing, (2) heating to a temperature of about 120° to 150° C. in a substantially nonoxidizing atmosphere, (3) mixing the heated material with sulfur, or a mixture of sulfur and asphalt, at 120° to 150° C. and for a time sufficient to permit thorough mixing and reaction between the sulfur and the asphalt fraction of the spent concrete, the amount of sulfur being about 20 to 50 percent by weight of the asphalt in the concrete, whereby the viscosity of the asphalt is lowered and its penetration point is increased with minimal lowering of the softening point.

2. The process of claim 1 in which microwave heating is employed to achieve the required temperature.

3. The process of claim 1 in which the sulfur is added in liquid form.

4. The process of claim 1 in which the recycled material is heated by mixing with hot, new aggregate materials to obtain a mix temperature of 120° to 150° C.

* * * * *